United States Patent [19]

Gill et al.

[11] Patent Number: 5,065,535

[45] Date of Patent: Nov. 19, 1991

[54] INDEXING SYSTEM FOR ROTARY GARMENT PRESS

[75] Inventors: Sarupinderpal S. Gill; Manohar Mohan, both of Cincinnati, Ohio

[73] Assignee: American Laundry Machinery, Inc., Cincinnati, Ohio

[21] Appl. No.: 545,647

[22] Filed: Jun. 29, 1990

[51] Int. Cl.[5] ..... D06F 71/10

[52] U.S. Cl. ..... 38/22; 38/42

[58] Field of Search ..... 38/4, 18, 21, 22, 23, 38/24; 223/39, 43, 57; 112/121.12; 29/35.5, 36, 40, 42, 45, 48.5

[56] References Cited

U.S. PATENT DOCUMENTS

| | | | |
|---|---|---|---|
| 2,202,483 | 5/1940 | Dewey | 38/22 |
| 2,203,359 | 6/1940 | McDougall | 223/57 |
| 2,241,373 | 5/1941 | Rawlinson et al. | 223/57 |
| 2,452,483 | 10/1948 | New House | 38/22 |
| 3,173,820 | 3/1965 | Adler | 156/369 |
| 3,174,662 | 3/1965 | Kannegiesser et al. | 223/57 |
| 3,262,345 | 7/1966 | Spohn et al. | 29/42 X |
| 3,464,602 | 9/1969 | Romansky | 223/57 |
| 4,304,263 | 12/1981 | Choate | 137/624.15 |
| 4,312,105 | 1/1982 | Brown | 29/35.5 X |
| 4,592,295 | 6/1986 | Cordier | 112/121.12 X |

FOREIGN PATENT DOCUMENTS

| | | | |
|---|---|---|---|
| 1158035 | 11/1963 | Fed. Rep. of Germany . | |
| 0625428 | 9/1961 | Italy | 38/22 |

*Primary Examiner*—Werner H. Schroeder
*Assistant Examiner*—Ismael Izaguirre
*Attorney, Agent, or Firm*—Bacon & Thomas

[57] ABSTRACT

An indexing system for a garment pressing machine includes a rotatable carriage having radial arms supporting circumferentially spaced pressing bucks moveable between dressing, pressing and unloading positions. A fluid drive arrangement includes a single linear reciprocating fluid actuator extendible and retractable under control of various solenoid valves that are controlled by a microprocessor which receives and processes signals from sensors indicating the degree of extension or retraction of the fluid actuator and the position of the rotatable carriage. A single cycle of retraction and extension of the fluid actuator results in rotation of the carriage by one position. Another cycle of retraction and extension of the actuator returns the drive system to a starting position ready to initiate another rotation of the carriage to its next position. The carriage can be cyclically indexed to move the bucks between their various operating positions every other retraction and extension cycle of the actuator. A special drive linkage between the actuator and carriage is used to enable a single linear actuator to cyclically rotate the carriage, and a latch is used to positively locate the carriage at each operative position.

16 Claims, 3 Drawing Sheets

INDEXING SYSTEM FOR ROTARY GARMENT PRESS

BACKGROUND OF THE INVENTION

This invention pertains to garment pressing systems having a rotatable carriage typically movable between dressing, pressing, and undressing positions. More particularly, the invention pertains to a drive mechanism for moving the carriage of such a system.

Rotary garment press drive systems are known in the prior art as exemplified by U.S. Pat. Nos. 2,203,359, 3,173,820 and 3,174,662. In each of these known prior art systems, a rotatable carriage supports numerous circumferentially spaced bucks. The carriages are rotated such that each buck sequentially passes through dressing, pressing, and undressing positions or work stations. In each of these known prior art systems, the carriages are rotated by means of a rotary electric motor and suitable gearing. Movement of carriages in these systems usually requires high input torque and therefore requires motors with high horsepower ratings. Furthermore, these motors must be precisely energized in order to assure that each buck will be properly aligned with the pressing plates used in the system which press the garment, typically a dress shirt, against a buck located at the pressing station.

In the above listed '820 patent, for example, a switch, mounted adjacent to the inside periphery of the carriage, includes a plunger that is movable into circumferentially spaced indentations in the carriage. Each time the plunger is received in one of the recesses, the actuating motor of the assembly is deenergized, thus bringing the bucks to rest at their respective processing stations. Following a prescribed period of time, the motor is again energized to rotate the carriage until the plunger is received into the next circumferentially spaced indentation. Although this arrangement aids in assuring proper alignment of the bucks at their respective stations, the electric drive motor must not only develop enough torque to rotate the carriage, but also must produce enough initial torque to dislodge the plunger from its respective indentation.

It is the object of the present invention to overcome the disadvantages associated with the prior art as discussed above by accomplishing precise intermittent rotary movement of a carriage of a rotary garment press between its various operating positions through the use of a simple linearly reciprocating actuator motor which can readily supply the necessary torque to initiate and continue rotation of the carriage.

In addition, it is a further object of the present invention to provide a locking device for properly positioning the carriage at the end of each rotary movement such that each buck is properly positioned at its respective working station but which is disengaged prior to subsequent rotation of the carriage so that the linear actuator need not develop additional torque to overcome the engagement force of the locking device.

It is still further an object of the invention to drive the carriage of the garment press in intermittent, unidirectional fashion through the use of a single linearly reciprocating actuator connected to the carriage through a motion transfer system that converts the reciprocating motion of the actuator to unidirectional intermittent rotary motion of the carriage.

It is still another object of the invention to utilize a reciprocating piston fluid motor and control valves that are electrically controlled through a microprocessor system to precisely cause the rotary indexing movement of the carriage of the garment press in a smooth, uninterrupted manner. Another objective is to utilize the microprocessor for controlling operation of the motion transfer mechanism as well as the operation of the locking device.

BRIEF SUMMARY OF THE INVENTION

In its preferred embodiment, the present invention provides a rotary driving or indexing system which utilizes a linear reciprocating, fluid driven (i.e. pneumatic or hydraulic) actuator motor to rotate a buck supporting carriage in intermittent, unidirectional fashion between sequential stopping positions. The indexing system is adapted for use in a rotary shirt body press and functions to index a carriage, having various bucks mounted at circumferentially (usually equally) spaced distances, through various operating positions required to complete the process of pressing the shirt so that it may be delivered to some external material handling equipment.

In a preferred embodiment, three pressing bucks are used and each buck on the carriage stops at three positions in the system. The first position is a loading position at which an operator loads a garment, i.e. a shirt onto the buck. The second position is a pressing position at which the shirt is pressed by a combination of methods including pressing the shirt between two heated metal plates and injecting a mixture of heated air and steam through the shirt from inside the buck. The third position is an unloading or undressing position at which the shirt is removed from the buck and delivered to some external material handling equipment.

The indexing system used to drive the carriage in intermittent, unidirectional rotary motion to advance the pressing bucks to each work position includes a linear reciprocating actuator motor connected to the carriage through a motion transfer arrangement that converts linear reciprocating movement of the actuator motor to unidirectional intermittent rotary motion in a smooth, cyclic manner. Essentially, the motion transfer arrangement enables the use of the single linear motor to continuous and cyclically rotate the carriage to advance each pressing buck to a different position in the system. The motion transfer arrangement preferably is separate from the carriage and is connected thereto through a flexible belt or link drive system that permits increased flexibility in designing different ratios of movement between the motion transfer device and the carriage. Preferably, the actuator motor is fluid actuated and suitable electrically controlled valves are utilized to control delivery of fluid to the actuator motor.

In addition, in order to assure that each buck is properly positioned at each of its operating stations, the indexing system includes a latch mechanism which is movable between a lock position in which it assures that a buck will not move beyond its desired operating station and an unlocking position at which the carriage is permitted to rotate. The extension and retraction of the fluid actuator, the selective coupling of the motion transfer arrangement to the actuator and the movement of the latch are synchronized in order to enable the indexing system to complete the cyclic operating motions of the bucks.

A microprocessor control system preferably is utilized to coordinate the operation of the entire system.

The microprocessor receives various electrical input signals indicative of the operating condition of the indexing system, and provides output signals that control the actuator motor, the motion transfer arrangement and the latch used to secure the carriage at a single position.

DETAILED DESCRIPTION OF THE PREFERRED EMBODIMENT

Figure 1:
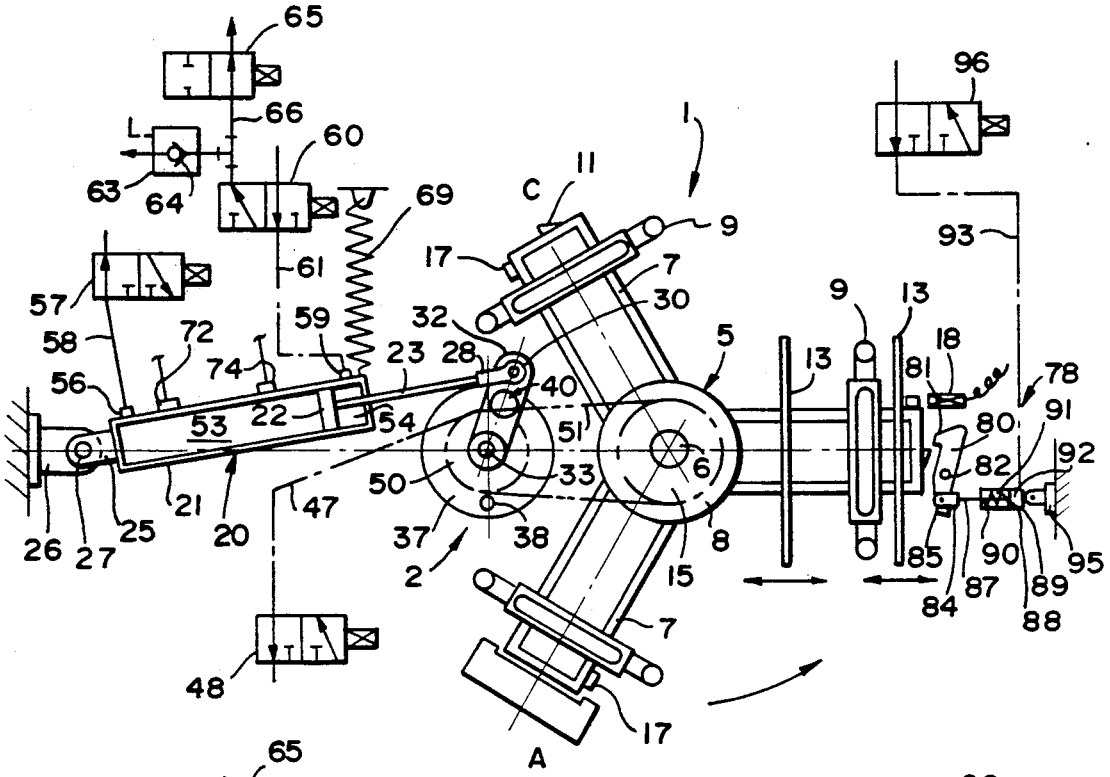
FIGS. 1–4 schematically show perspective views of the rotary garment press indexing system according to the present invention as the actuator motor drives the carriage of the press through one advancement cycle.

In accordance with the preferred embodiment, the rotary indexing system of the present invention is generally indicated at 1, and includes a carriage 5 upon which three pressing bucks 9 are mounted. Referring to FIG. 1, the carriage 5 is mounted to rotate about a generally central axis defined by shaft 6. The power delivered in order to rotate carriage 5 is supplied by a linear reciprocating fluid actuator motor generally indicated at 20 which may be selectively drivingly connected to the carriage 5 through a drive motion transfer device 2. The indexing system is arranged such that, when the actuator 20 is selectively connected to the carriage 5 through the motion transfer device 2, linear movement of the fluid actuator 20 will cause rotation of the carriage 5 in a single predetermined direction through an arc of rotation. A fluid motor control circuit is provided and includes solenoid valves 48, 57, 60 and 65 which control the flow of pressurized fluid to the actuator motor 20 and the motion transfer device 2 in order to perform the functions of selectively locking the linear fluid actuator 20 to the drive transfer device and selectively extending and retracting the linear fluid actuator 20.

As will be described in more detail hereinafter, indexing (i.e the advancement through a preselected arc of rotation) of the carriage 5 is initiated with the carriage 5, drive or motion transfer device 2 and actuator 20 disposed in the positions illustrated in FIG. 1. In this position, the actuator 20 is fully extended and the carriage 5 is disposed such that a pressing buck 9 mounted on a radial arm 7 of carriage 5 is disposed at a pressing station B. The other radial arms of the carriage 5 are respectively disposed at other work stations A and C, which will be described momentarily.

When it is desired to then advance each pressing buck 9 to a succeeding work station which, in this example, requires rotation of carriage 5 through an arc of rotation of 120° the use of a linear reciprocating motor to index carriage 5 through an arc of 120° presents an immediate design problem, since, unlike a rotary motor, a linear actuator can only provide a working stroke along a single actuating direction, thereby requiring conversion of such motion into rotary indexing motion. In accordance with the present invention, actuator 20 is connected to a motion transfer device 2 that utilizes a detent system for selectively connecting a motor drive disc drive lever 32 through an arc of travel sufficient to index the carriage 5 as required to advance each pressing buck to a succeeding work station. The drive transfer device 2 in the preferred embodiment is connected to the carriage 5 through a suitable flexible drive belt, link chain or equivalent 51 to complete the transmittal of motion from the actuator 20 to the carriage 5. In a manner that will be explained below, shortening of the length of actuator 20 will cause counterclockwise rotary motion of lever 32 about central axis 33 of drive transfer device 2 and will cause counterclockwise motion of drive disc 37 also about central axis 33 until the actuator is fully in retracted condition, at which point the actuator and the drive transfer device 2 will be in a "centered" position whereat the pivot point 27 of actuator 20 and the central axis 33 will lie in a common plane with the connecting point 30 between the actuator 20 and the lever 32. Such centered position is actually a dead spot at which actuator 20 is ineffective to cause rotary motion of carriage 5. However, the invention utilizes the momentum of carriage 5 after rotary motion has been initiated to carry the lever 32 past the centered position, whereupon the actuator 20 is controlled to extend its length to continue rotary motion of the disc 37 of the drive transfer device 2 in the same direction beyond the centered position. In this manner, carriage 5 can be moved from a starting point with the lever 32 on one side of axis 33, through the centered position and beyond the position whereat lever 32 will be disposed on the other side of axis 33. During the course of this movement, the actuator 20 will move from a substantially extended position through a shortened or retracted position and then back to an extended position to effect indexing of carriage 5 from one work position to the next. As will be described in more detail below the ratio of movement of the drive transfer device 2 relative to the movement of carriage 5 can be varied to effect desired ratios of motion.

After actuator 20 has completed its extension and rotated drive lever 32 to its full counterclockwise position, the lever 32 is uncoupled from the disc 37 by release of a detent mechanism to be described below and actuator 20 is retracted to cause clockwise rotation of lever 32 about central axis 33. A spring 69 or the equivalent is provided to bias the end of actuator opposite pivot 27 to aid in moving actuator 20 past the centered position about pivot 27 as the actuator reaches its full retracted condition, following which the actuator is again extended to drive lever 32 back to its initial starting position, so that, upon completion of extension of actuator 20, the elements again appear as illustrated in FIG. 1.

Figure 5:
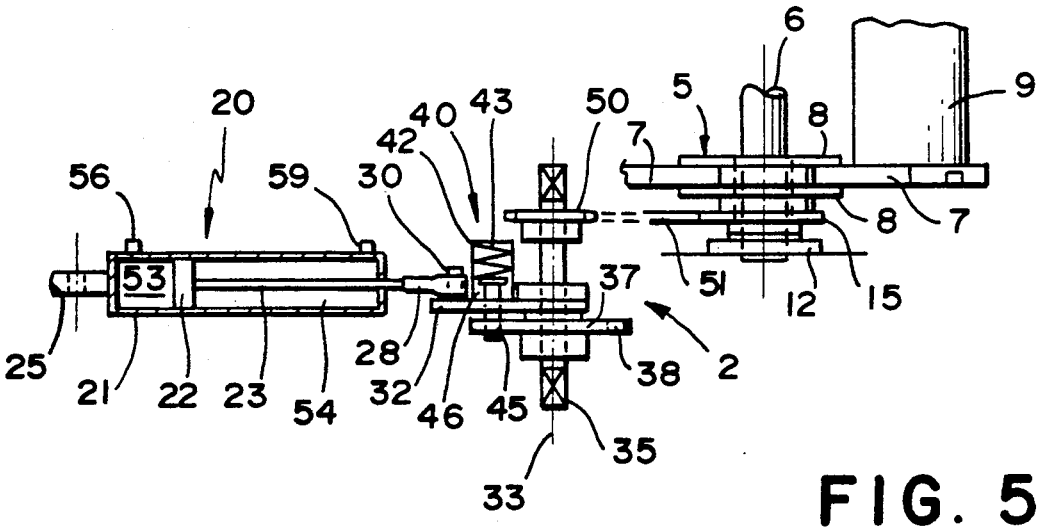
FIG. 5 is a schematic side elevation view of the indexing system.

The preferred embodiment of the indexing mechanism will now be described in more detail. The carriage 5 preferably includes three equally circumferentially spaced radial arms 7. As shown in FIG. 5, each arm 7 is located between a pair of mounting plates 8 constituting part of carriage 5. Mounting plates 8 are freely rotatable about generally central shaft 6. Adjacent the ends of each of the three arms 7 is mounted a pressing buck 9. The carriage 5, arms 7 and each buck 9 are therefore rotatable about an axis defined by shaft 6 between a dressing position A, a pressing position B and a unloading or undressing position C. At the loading position A, an operator loads a garment such as a shirt onto the buck. At the pressing position B, the shirt is pressed (ironed) by a combination of methods including, for example, pressing the shirt between two heated metal plates 13 and injecting a mixture of heated air and steam through the shirt from inside the buck 9, as is common in the art. At the position C, the shirt is removed from the buck 9 either by another operator or a suitable handling mechanism and is then delivered to an appropriate external material handling device, for example a conveyor.

Although the preferred embodiment of the carriage is a three position turret, it should be understood that the invention is directed to the manner in which the carriage 5 is rotated and properly aligned at the various positions A–C and, therefore, the exact number of arms 7 provided can be varied, depending on the number of work stations utilized. For example, the invention could be carried out with a single arm movable between two work stations, or with a plurality of arms movable between a plurality of workstations.

Referring to FIG. 5, the shaft 6, which defines the axis about which carriage 5 rotates, is secured by means of a mounting plate 12 to a stationary support. Fixedly attached to and therefore rotatable with the carriage 5 is a driven sprocket !5 which could be a belt pulley or a chain sprocket or the like.

Fluid actuator 20 includes a cylinder 21 in which is disposed a piston head 22 and a piston rod 23. One end of the cylinder 21 has fixedly secured thereto a tab 25 pivotally mounted to a fixed bifurcated mounting bracket 26 by means of a pivot pin 27. The piston rod 23 extends through the opposite end of the cylinder 21 and has an end connector 28 fixedly secured thereto by any means known in the art such as, for example, a threaded connection or welding. The rod 23 thus reciprocates linearly along an "actuating axis" defined by the longitudinal axis of the actuator 20. The pin 27, of course, lies on the actuating axis as illustrated in this embodiment.

End connector 28 is rotatably connected to a disc drive lever 32 of the drive motion transfer device 2 by an upstanding drive pin 30 or other suitable connector secured to the disc drive lever 32. The other end of the disc drive lever 32 is freely rotatably mounted upon an intermediate shaft 35 that is substantially parallel to, but offset from, shaft 6. Mounted vertically below disc drive lever 32, as represented in FIG. 5, is a drive disc 3 fixedly secured to shaft 35 such that rotation of drive disc 37 results in rotation of intermediate shaft 35 or rotation of the disc about generally central pivot axis 33. Also fixedly mounted to intermediate shaft 35 is a drive pulley or sprocket 50 located in substantially the same plane as driven pulley or sprocket 15. Drive sprocket 50 and driven sprocket 15 are interconnected by a belt, chain, or the equivalent 51.

Thus, it will be seen that extension and retraction of piston rod 23 of fluid actuator 20 functions to rotate disc drive lever 32 about a pivot axis 33 defined by intermediate shaft 35. It can be readily seen from viewing FIGS. 1–4 that extension and retraction of piston rod 23 causes fluid actuator 20 to pass through a centered or "dead" position at which the linear fluid actuator 20 cannot impart a rotary force to the drive disc lever 32. The centered position occurs when the axis of pivot pin 27, drive pin 30 and pivot axis 33 are aligned in a common plane, or in this embodiment, when the actuating axis intersects pin 30 and axis 33. The indexing system of the present invention therefore provides for moving the fluid actuator 20 past this centered position during both the drive cycle of the fluid actuator 20 shown in FIGS. 1–4 and the opposite return cycle of the actuator. As will be discussed more fully herein, during the drive cycle, the momentum of the rotating carriage 5 is utilized to carry the fluid actuator 20 and the drive transfer device through this centered position. In order to permit movement through the centered position during the return cycle, a spring 69 is connected between the end of cylinder 21 through which piston rod 23 extends and a fixed support. During the drive cycle, the spring 69 is placed in tension such that during the return cycle it may apply a force to cylinder 21 in order to pull the fluid actuator 20 through the centered position.

Figure 6:
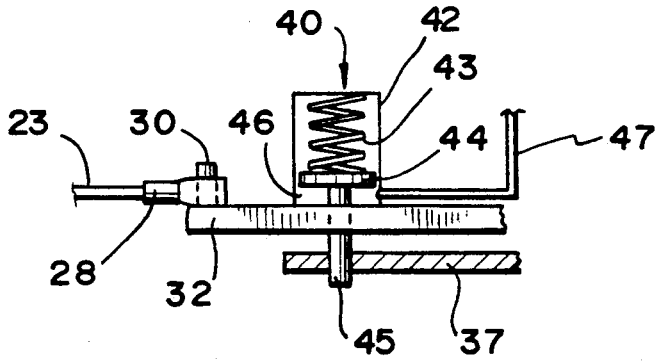
FIG. 6 is a schematic enlarged view of the detent arrangement used in the motion transfer device of the indexing system.

In order for rotation of disc drive lever 32 to impart rotation to drive disc 37, a selectively engageable detent or coupling means is provided to interconnect drive lever 32 and drive disc 37. This interconnecting means is constituted in the present invention by drive lock actuator 40 fixedly secured to drive disc lever 32 and a pair of apertures 38 spaced 180° apart in drive disc 37, as will be more fully explained below with particular reference to FIGS. 5 and 6.

Drive lock actuator 40 includes a sealed casing 42 mounted upon an upper surface of the disc drive lever 32 intermediate the location of upstanding pin 30 and intermediate shaft 35. Drive lock actuator 40 further includes a locking pin 45 having a head 44. The locking pin 45 is biased by a spring 43, acting between an upper portion of the sealed casing 42 and the locking pin head 44, toward a downward or locking position at which locking pin 45 extends into one of apertures 38 for drivingly connecting disc drive lever 32 with drive disc 37.

Defined within the sealed casing 42, between the disc drive lever 32 and the locking pin head 44, is a release chamber 46. Release chamber 46 is part of a fluid circuit including fluid supply line 47 which will be described in detail below. At this point, it need merely be understood that fluid pressure may be selectively supplied into release chamber 46 via line 47 which will apply an upward force to locking pin head 44 and function to move the locking pin 45 against the force of spring 43 to an unlocked position. In this unlocked position, the locking pin 45 is disengaged from either of the apertures 38 in drive disc 37. Control of the drive lock actuator 40 will be described more fully hereinafter with reference to the hydraulic circuit of the present invention and FIGS. 1–4 which show the operation of the indexing system throughout its entire range of travel.

As previously mentioned, the indexing system of the present invention includes an hydraulic circuit for supplying pressurized fluid to release chamber 46 in order to move locking pin 45 to its unlocked position and for extension and retraction of fluid actuator 20. The hydraulic circuit includes a source of pressurized fluid (not shown), various fluid lines 47,58,61,66,93 and various fluid flow control valves 48,57,60,63,65,96. Each of valves 48,57,60,65 and 96 are two-position solenoid valves in the preferred embodiment. In one position thereof, each of the valves permits the flow of pressurized fluid from the pressure source through a respective fluid line. In their other position, each of these solenoid valves permits fluid to drain through their respective fluid lines to a reservoir or sump. Valve 63 is a ball-type, one-way valve which permits regulated flow from fluid line 66 to the reservoir or sump. The solenoid valves 48,57,60,63,65 and 96 are controlled by means of a central processing unit (CPU) based on various sensed signals. That portion of the hydraulic circuit utilized to extend and retract piston rod 23 of fluid actuator 20 and move locking pin 45 to its unlocked position will now be described.

The extension and retraction of the piston rod 23 of the fluid actuator 20 along with the actuation of locking pin 45 is controlled by means of associated fluid control valves 48, 57, 60, 63 and 65; fluid lines 47, 58, 61, 66, and 67 and a microcomputer processing unit labelled as "CPU". As previously mentioned, locking pin 45 normally is biased in a downward or locking position into engagement with one of apertures 38 on drive disc 37 by means of spring 43. A two position solenoid drive release valve 48 controls flow of pressurized actuating fluid in fluid line 47 into and out of release chamber 46 associated with the drive lock actuator 40. Solenoid drive release valve 48 is controlled via the CPU between its two positions. In one position, the solenoid drive release valve 48 permits the supply of pressurized fluid into release chamber 46 through fluid line 47 in order to retract and disengage locking pin 45 from an associated aperture 38 in the drive disc 37. In its second position, fluid pressure is released from release chamber 46 by communicating release chamber 46 with the reservoir or sump through fluid line 47, at which time, spring 43 will again bias locking pin 45 into an engagement position with one of the apertures 38 in drive disc 37. It should be noted that spring 43 merely biases locking pin 45 against drive disc 37 and it is the actual relative rotation between disc drive lever 32 and disc 37 by means of fluid actuator 20 that causes locking pin 45 to become aligned and engaged with an aperture 38 and thereby drivingly connect disc drive lever 32 and drive disc 37.

Piston head 22 of the fluid actuator 20 divides cylinder 21 into two chambers, i.e. an extension chamber 53 and a retraction chamber 54. Adjacent the ends of the cylinder 21 are mounted fittings 56 and 59 respectively. Fitting 56 opens up into extension chamber 53 and fitting 59 opens into retraction chamber 54. Attached to fitting 56 is a fluid line 58 which interconnects the solenoid extension valve 57 with extension chamber 53. Solenoid extension valve 57 is controlled via the CPU to assume one of two positions. In one position, extension chamber 53 is connected with the reservoir or sump through fitting 56, fluid line 58 and solenoid extension valve 57. In the other position of solenoid extension valve 57, pressurized fluid will be supplied into extension chamber 53 to create a force against piston head 22 to extend piston rod 23.

Attached to fitting 59 is a fluid line 61 which, in turn, is connected at its other end to a solenoid retraction valve 60. Solenoid retraction valve 60 is also controlled via the CPU to assume one of two positions. In one position thereof, solenoid retraction valve 60 permits fluid to flow into line 61, through fitting 59 and into retraction chamber 54. While in this position fluid pressure is supplied to a second side of piston head 22 and forces piston rod 23 to retract within cylinder 21 of fluid actuator 20. In the other position, fluid line 61 is fluidly interconnected with a flow control valve 63 and a solenoid deceleration valve 65.

Flow control valve 63 and solenoid deceleration valve 65 are located in parallel. Flow control valve 63 permits flow of fluid in only one direction i.e. out of retraction chamber 54. Flow control valve 63 includes a ball check element 64 in order to accomplish this function. Solenoid deceleration valve 65 is also a two position solenoid valve controlled via the CPU. In one position thereof, fluid flow is permitted to flow through solenoid deceleration valve 65 out of retraction chamber 54. In its other position, solenoid deceleration valve 65 prevents flow of fluid therethrough. The combined operations of these valves will be described more fully below with respect to an operating cycle of the indexing system.

Before describing an operating cycle of the indexing system, the manner in which the carriage 5 is selectively locked in a desired position and the various electrical sensors which are used by the CPU in order to control the various solenoid valves will now be described. Each arm 7 includes a catch 11 located at a distal end thereof. The indexing system of the present invention is provided with a latching mechanism, generally indicated at 78, which cooperates with these catches to assure proper final positioning of the bucks 9 during operation of the system. Latching mechanism 78 includes a pawl 80 which is pivotable at a central location thereof about pawl pivot pin 82. At one of end of pawl 80 is a latch portion 81 which, in a latching position, engages with a catch 11 on one of the arms 7 to assure proper positioning of the carriage 5. A clevis 84, pivotally connected to the other end of the pawl 80 by a pin 85 is attached to a reciprocally movable piston assembly including a rod 87 and a piston head 88. The piston head 88 is located within cylinder housing 89 with rod 87 extending through an opening in the end of the cylinder housing 89 facing the pawl 80.

The other end of the cylinder housing 89 is pivotally attached to a fixed support 95. The piston head 88 divides cylinder housing 89 into two chambers. One chamber, a latch engagement chamber 91, includes a spring 90 which surrounds a portion of rod 87 and is biased between one end of the cylinder housing 89 and one face of the piston head 88. The spring 90, therefore, tends to normally bias the piston rod 87 and associated latch portion 81 of pawl 80 into a latching position. The other chamber, called the latch release chamber 92, is disposed between piston head 88 and housing 89. Latch release chamber 92 is in fluid communication, by means of fluid line 93, with a solenoid latch valve 96 controlled via the CPU. Solenoid latch valve 96 is a two position solenoid valve permitting fluid to flow from a pressure source (not shown) into latch release chamber 92, in one position thereof, in order to pivot pawl 80 against the force of spring 90 into an unlatched position. In its other position, solenoid latch valve 96 permits fluid pressure to be released from latch release chamber 92.

To enable detection of the position of each radial arm 7 as it approaches, for example, pressing station B, each arm 7 is provided with a home indicator 17 that is detectable by a position sensor 18 at the pressing station. Position sensor 18 responds to the proximity of indicator 17 to generate a signal indicative of the proximity of arm 17 to the pressing station B. The manner in which the signal is utilized will be discussed below in connection with the microprocessor CPU system.

The actuator 20 is provided with a centered position or "overcenter" sensor 72 and a deceleration sensor 74. Overcenter sensor 72 and deceleration sensor 74 are mounted on a side of cylinder 21 at intermediate positions along its length. Overcenter sensor 72 is located closer to fitting 56 along the length of cylinder 21 and senses the position of piston 22 within cylinder 21 just prior to and just subsequent to fluid actuator 20 and link 32 reaching their centered position, at which point the actuator 20 is generally retracted or shortened. The sensor 72 generates an overcenter signal indicative of the centered relationship of actuator 20 and link 33. Deceleration sensor 74 is located at about the midpoint between center and fully extended positions of the actuator, senses the proximity of piston 22, and outputs a deceleration signal at least during extension phases of fluid actuator 20 to initiate a control over actuator 20 to slow its extension rate as it approaches full extension. It can also be used during retraction to control retraction speed.

The exact positioning of sensors 72 and 74 along the length of cylinder 21 is determined based on the length of the actuator motor and the degree of extension and retraction available for the piston head 22 and piston rod 23 throughout their entire range of travel. Overcenter sensor 72 should be located in a position such that it senses the position of piston 22 as the actuator reaches the centered position. Furthermore, deceleration sensor 74 must be positioned along cylinder 21 an adequate distance from the fully extended position of piston 22 to enable the control system to process the deceleration signal and effect proper shifting of various solenoid valves to enable the fluid actuator to gradually come to its fully extended position at a reduced rate.

Figure 7:
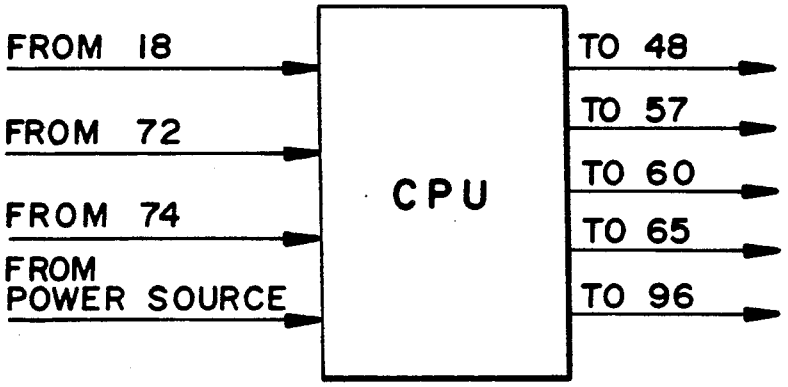
FIG. 7 is a schematic view depicting the microprocessor CPU inputs and outputs in accordance with the present invention.

Considering next the control system for the motion transfer device 2, the latch 78 and the actuator 20, it should be noted at this point that various sensors have been described to provide various signals available to the control system is used in the invention. For example, a position signal is generated by position sensor 18 to detect the proximity of radial arm 7 to pressing station B. An overcenter signal is generated at sensor 72 indicative of the centered or approximately centered position of the actuator 20 and disc drive link 32. A deceleration sensor 74 provides a deceleration signal indicative of the approaching extended position of actuator 20. With reference to FIG. 7, these various signals are transmitted by appropriate signal transmitting means, for example electrical conductors, to a microprocessor CPU that constitutes a preferred control system for this invention. As seen in FIG. 7, the CPU receives and processes signals from sensors 18, 72 and 74 and is also provided with an appropriate source of power. Within the CPU, various algorithms and other logic circuits process the incoming signals and provide output signals to the solenoid valves 48, 57, 60, 65 and 96 in accordance with a suitable program to effect smooth intermittent rotation of carriage 5.

The CPU itself and its associated hardware are conventional, and do not constitute an inventive aspect of the present invention. Based on the desired manner in which the solenoid valves are controlled, various known processing units could be employed to carry out the operation of the indexing system of the present invention.

Reference will now be made to FIGS. 1–4 in describing one cycle of the cyclic operation of the present indexing system. In FIG. 1, pressing plates 13 have completed the pressing of a garment (not illustrated) mounted on buck 9 and have retracted. The CPU sends an electrical signal to energize the solenoid latch valve 96 to cause pressurized fluid to flow through fluid line 93 into latch release chamber 92. As latch release chamber 92 becomes pressurized, rod 87 is extended causing pawl 80 to pivot about pawl pivot pin 82 and for latch portion 81 to become disengaged from catch 11. At this point, the CPU sends a signal to solenoid drive release valve 48, which is normally maintained in an open or pressure release position, in order to permit fluid to flow from release chamber 46 through fluid line 47 to a reservoir, i.e. to exhaust release chamber 46. Locking pin 45 Will then be biased by spring 43 into a downward or locking position at which locking pin 45 will bear down against the upper surface of drive disc 37. In this position, as is clearly evident in FIG. 1, piston head 22 of fluid actuator 20 is located in cylinder 21 forward of both overcenter sensor 72 and deceleration sensor 74.

At this point, the CPU causes solenoid extension valve 57 to assume its pressure release position such that fluid within extension chamber 53 can readily pass through fitting 56 and fluid line 58 to a reservoir or vent. Simultaneously, or at an appropriate moment, the CPU sends a signal to solenoid retraction valve 60 to cause the same to interconnect the fluid supply source (not shown) to fluid line 61 and, through fitting 59, to retraction chamber 54. By supplying fluid pressure to retraction chamber 54 and permitting the exhaust of fluid in extension chamber 53, piston rod 23 is caused to retract within cylinder 21. During the initial retraction stroke of piston rod 23, locking pin 45 will become aligned with one of the apertures 38 in disc drive 37 and, due to the biasing force of spring 43, disc drive lever 32 and drive disc 37 will be interconnected by locking pin 45. As piston rod 23 retracts further within cylinder 21, the disc drive lever 32 is driven in a counterclockwise direction as viewed in FIGS. 1–4. As the piston rod 23 continues to retract, piston head 22 passes by deceleration sensor 74 and drive disc 37 is rotated through about 90° of counterclockwise rotation towards the centered position.

Figure 2:
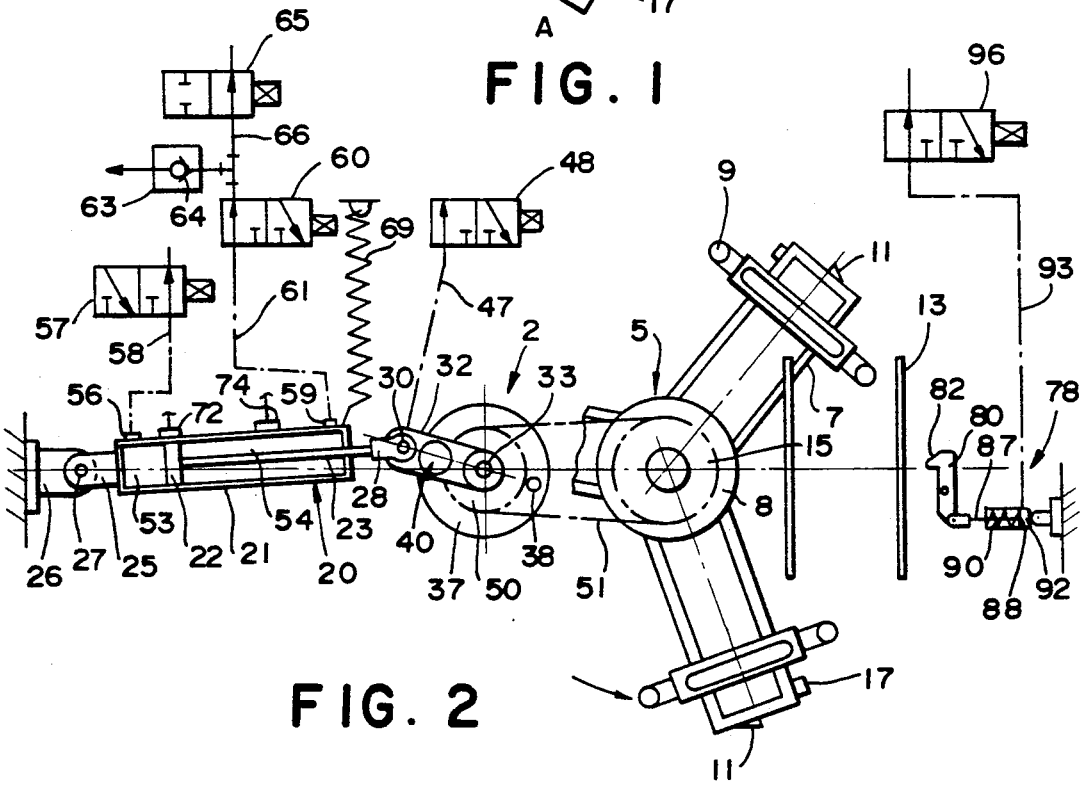

Referring to FIG. 2, as the piston head 22 of the fluid actuator 20 passes the overcenter sensor 72, an electrical signal is sent to the CPU in order to signal that the fluid actuator 20 is approaching the centered position. As a result of receiving this signal, the CPU controls the solenoid of solenoid retraction valve 60 in order to permit exhausting of fluid pressure from retraction chamber 54. At this point, both solenoid extension valve 57 and solenoid retraction valve 60 are in their exhaust positions. The momentum of the rotating carriage 5 causes rotation of the drive disc lever 32 and drive disc 37 to continue past the centered position. Therefore, although the fluid actuator 20 cannot rotate disc drive lever 32, drive disc 37 and carriage 5 at the centered position as previously discussed, the momentum of the rotating carriage is used to overcome this dead drive position during this phase of the indexing operation. Once the fluid actuator 20 is pivoted beyond the centered position, it may again function to provide rotary drive power to the carriage.

Figure 3:
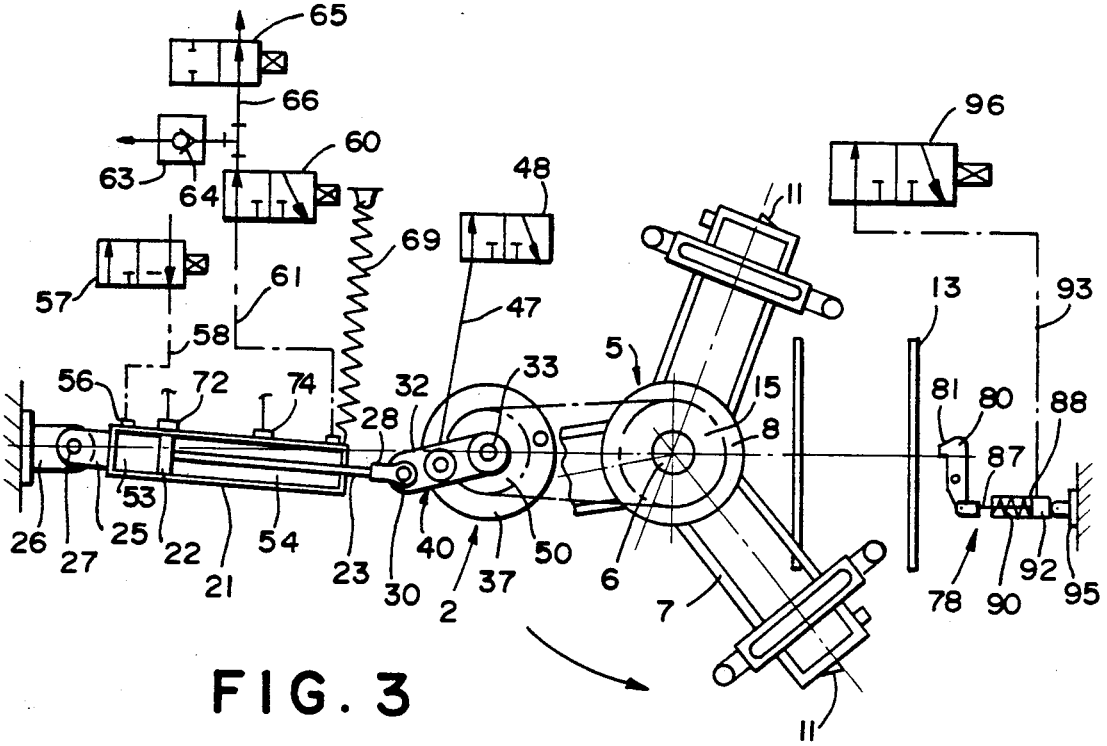

After a time delay sufficient to permit rotation of the drive actuator 20 and drive disc 37 past centered position, the indexing system will be positioned as shown in FIG. 3 and the CPU outputs a signal to change the position of solenoid extension valve 57. The CPU also outputs a signal to change the position of solenoid latch valve 96 so as to permit depressurization of latch release chamber 92. Upon exhausting latch release chamber 92, the biasing force of spring 90 will pivot pawl 80 about pawl pivot pin 82 and latch portion 81 of pawl 80 will be in the proper position to engage the catch 11 on the next succeeding arm 7. Since solenoid retraction valve 60 is still in its exhaust position, solenoid deceleration valve 65 is also in an exhaust position, and solenoid extension valve 57 is directing fluid to flow into extension chamber 53, piston rod 23 will be extended to continue rotation of the drive disc 37 through disc drive lever 32 and locking pin 45 in the same direction. Fluid then exhausts from retraction chamber 54 through fluid line 61, solenoid retraction valve 60, fluid line 66, flow control valve 63 and solenoid deceleration valve 65.

Figure 4:
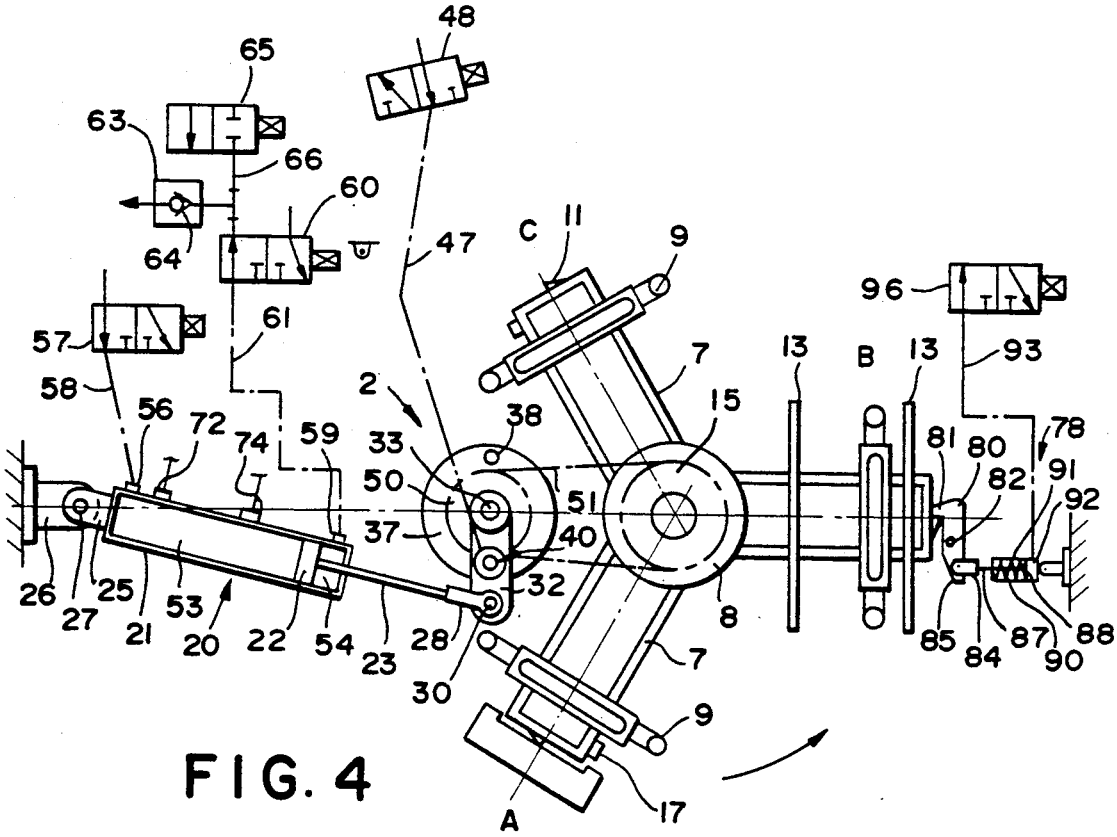

As piston head 22 of fluid actuator 20 passes deceleration sensor 74 (in a position between that shown in FIGS. 3 and 4) an electrical signal from deceleration sensor 74 causes the CPU to output a signal to solenoid deceleration valve 65 to prevent fluid flow therethrough as shown in FIG. 4. Therefore, fluid from retraction chamber 54 may only be exhausted through flow control valve 63, thereby reducing the rate of exhaust of fluid from retraction chamber 54. Extension of the piston rod 23 of fluid actuator 20 and consequently the rotation of disc drive lever 32 and drive disc 37 is slowed by the cushioning effect of the restricted flow rate. This cushioning effect permits the carriage 5 to approach the home position gradually at a rate of rotation less than the full rate between home positions. As rotation of the carriage gradually continues at a slower rate, catch 11 on the successive arm 7 engages latch portion 81 of pawl 80 and positively stops rotation of the carriage. At this point, home indicator sensor 18 electrically senses the position of home indicator 17 and sends a proximity signal to the CPU indicating that indexing of the carriage to the next stage is complete.

It is to be noted that in the preferred embodiment, three radial arms 7 are associated with carriage 5, with the arms circumferentially separated at 120° intervals. The drive disc 37, on the other hand is provided with a pair of apertures 38 constituting drive disc detents separated circumferentially on disc 37 by 180°. To achieve rotation of carriage 5 120° as a result of rotation of disc 37 180°, the sizes of drive sprocket 50 and driven sprocket 15 are dimensioned such that a suitable speed ratio between the driving and driven sprockets is achieved so that 180° rotation of drive sprocket 50 produces 120° rotation of driven sprocket 15. In this manner, the reciprocal movement of actuator 20 driving lever 32 through 180° achieves a 120° rotation of carriage 5 and the advancement of each radial arm to the next work processing station.

Although the carriage 5 has completed its indexing, fluid actuator 20 and drive disc lever 32 are in the position shown in FIG. 4 and must be returned to their respective starting positions as indicated in FIG. 1 without rotation of carriage 5. The CPU therefore outputs a signal to switch the position of solenoid drive release valve 48 to cause pressurized fluid to flow into release chamber 46 and disengage locking pin 45 with its associated aperture 38 in drive disc 37. The CPU again outputs a signal to switch the position of solenoid extension valve 57 so as to permit exhausting of extension chamber 53. Simultaneously, the CPU outputs a signal to cause fluid pressure to be supplied through solenoid retraction valve 60 into retraction chamber 54 thereby causing piston rod 23 to begin retracting within cylinder 21. Disc drive lever 32 will then be rotated in a clockwise direction without a corresponding rotation of drive disc 37 or carriage 5.

As piston head 22 of fluid actuator 20 passes overcenter sensor 72, the CPU again changes the position of solenoid retraction valve 60 to an exhaust position. Now, return spring 69 will cause rotation of the actuator 20 about pivot pin 27 and the disc drive lever 32 so they continue rotation past the actuator 20 about pivot pin 27 and the centered position by biasing an end of fluid actuator 20, remote from pivot pin 27, upwardly. After a time delay sufficient to permit rotation of the disc drive lever 32 past the centered position, the CPU outputs a signal to solenoid extension valve 57 so as to again pressurize extension chamber 53 and cause continued extension of piston rod 23.

When piston 22 again reaches deceleration sensor 74, a signal will be sent to the CPU in order to again control the rate at which piston rod 23 will extend so that it will gradually come to its original stop position shown in FIG. 1 where the locking pin is located slightly clockwise of the other aperture 38. By this time, solenoid extension valve 57 will have been shifted to the position shown in FIG. 1, pressing plates 13 would have already been pressed against the succeeding buck 9, the previously pressed garment would have been removed off the last buck and the next garment would have been draped around the third buck at the dressing location. Therefore, one complete cycle of the indexing system would have been completed and the mechanism would be ready to repeat the process again.

In the preferred embodiment, the indexing system utilizes air as the pressurizing fluid medium. It is to be understood, however that other mediums such as hydraulic fluid could be utilized. All of the solenoid valves 48, 57, 60, 65 and 96 are normally open to an exhaust position and electrically energized to their other operating positions in a manner known in the art.

Although the invention is described herein with respect to a particular embodiment, it can be readily seen that various changes and/or modifications may be made by persons skilled in the art without departing from the spirit or scope of the invention. For instance, it is possible to utilize a different suitable drive arrangement such as a pulley and belt drive system between the intermediate shaft 35 and carriage mounted shaft 6 instead of the chain drive arrangement described. It is even possible to mount the carriage 5 and drive disc 37 on a common shaft or to combine the assembly together; however, the separate transfer drive arrangement is preferred since a variable drive ratio is available so that 180° of rotation of the disc drive lever 32 can produce 120° rotation of the carriage 5, or any other suitable ratio. Thus, the indexing system of the present invention may be utilized in a similar manner with a carriage 5 with more or less arms 7 by merely adjusting the drive ratio between sprockets 15 and 50. If only two arms are utilized, for example, a one-to-one drive ratio could be utilized; if four arms were utilized, a one-to-two ratio could be used and so on.

It is to be noted that various elements illustrated as the preferred embodiment could be reversed without changing the scope of the invention. For example, the piston actuators could be arranged such that the piston and cylinder arrangement is reversed, with the cylinder constituting the moveable element and the piston being secured against longitudinal movement. Various spring biasing elements could be utilized without necessarily using a coil spring. The relative direction of movement of various components could be changed without departing from the spirit and scope of the invention. The solenoid valves and various fluid circuit elements could be arranged in any suitable manner known in the art to achieve the same function as described in connection with the exemplary preferred embodiment. The particular arrangement and shape of the pressing plates and the bucks utilized in the system could be changed without departing from the invention. The actuator motor 20 could be a linear electrical actuator with suitable controls arranged to function as the equivalent of actuator 20 and its associated control valves.

Accordingly, the preferred embodiment illustrated herein is intended to be exemplary only and it is to be understood that modifications of the preferred embodiment could be made by a person skilled in the art to achieve the function of the invention as described herein without departing from the spirit and scope of the invention, which are defined by the claims appended hereto.

We claim:

1. A garment press comprising:

a carriage having at least one radial arm for supporting a pressing buck and rotatably mounted for motion about a rotational axis extending generally perpendicular to said at least one radial arm;

indexing means for intermittently rotating the carriage in a single direction to sequentially align said at least one radial arm with at least one work station position, said indexing means including a linearly reciprocating actuator means and a motion transfer means between said actuator means and said carriage, said motion transfer means including a reciprocating to intermittent unidirectional rotary motion converter mechanism connected by a motion transmitting coupling to said carriage.

2. A garment press as claimed in claim 1, said carriage having a plurality of pressing buck supporting radial arms, and said indexing means arranged to intermittently rotate the carriage in a single direction to sequentially align each of said radial arms with said at least one work station position.

3. A garment press as claimed in claim 1, including latch means for positively stopping rotational movement of the carriage when said at least one radial arm is aligned at said at least one work station position.

4. A garment press as claimed in claim 3, including a position sensor for sensing the proximity of said at least one radial arm relative to said at least one work station position and for generating a position signal indicative of said proximity.

5. A garment press as claimed in claim 1, said motion converter mechanism including a drive disc means for driving said carriage, said drive disc means being rotatable about a central axis and including a disc detent means thereon; a disc drive lever rotatable about said central axis and having disc drive lever detent means thereon; said disc detent means and disc drive lever detent means being selectively operable to either couple the drive disc means and disc drive lever together for simultaneous rotary motion or to enable free rotation of the drive disc means relative to the disc drive lever; said actuator means being operatively connected to said disc drive lever for causing oscillation of said disc drive lever about said central axis upon reciprocating movement of the actuator means; whereby, upon oscillation of said disc drive lever, and selective actuation of said disc drive lever detent means and said drive disc detent means, said drive disc is rotated intermittently in a single direction upon reciprocating linear motion of said actuator means.

6. A garment press as claimed in claim 3, said actuator means including a longitudinally fixed element and a relatively longitudinally slidable element, said slidable element moveable along an actuating axis relative to said fixed element, said slidable element moveable towards and away from said central axis and being attached to said disc drive lever for rotating the lever about said central axis; said longitudinally fixed element being pivotally attached to a support; said fixed and slidable elements arranged to rotate the disc drive lever towards a centered position whereat the actuating axis and central axis lie in a common plane; and control means for causing periodic reciprocation of said actuator means to cause the disc drive lever means to rotate about said central axis to said centered position and to cause the disc drive lever to continue rotating in the same direction after the lever has moved past said centered position; said carriage, actuator means and rotary motion converter mechanism arranged to enable rotation of the disc drive lever means past the centered position by the effective momentum of rotary motion of the carriage following initiation of such rotary motion by said actuator means.

7. A garment press as claimed in claim 6, including a deceleration control means for said actuator means for causing the relatively slidable element to decrease in velocity when approaching a maximum extension point of the actuator means.

8. A garment press as claimed in claim 1, wherein said motion transmitting coupling comprises a flexible drive element.

9. A garment press as claimed in claim 1, wherein said motion converter mechanism and carriage are coupled together by said motion transmitting coupling so as to rotate relative to each other at different velocities.

10. A garment press as claimed in claim 1, including means for generating actuator control signals, a latch release control signal, and disc drive control signals;

actuator control means for regulating the actuation of said actuator means in response to said actuator control signals;

a latch means for positively stopping rotational movement of the carriage when said at least one radial arm is aligned with said at least one work station position and including a latch release actuator means for releasing the latch in response to said latch release control signal;

said indexing means including a motion transfer means between said actuator means and said carriage, said motion transfer means including a reciprocating to intermittent unidirectional rotary motion converter mechanism that comprises a drive disc means for driving said carriage, said drive disc means rotatable about a central axis and including disc detent means thereon; a disc drive lever rotatable about said central axis and having disc drive lever detent means thereon; said disc detent means and disc drive lever detent means being selectively operable to either couple the disc means and disc drive lever together for simultaneous rotary motion or to enable free rotation of the drive disc means relative to the disc drive lever; said actuator means being operatively connected to said disc drive lever for causing said disc drive lever to oscillate about said central axis upon reciprocating movement of the actuator means; whereby, upon oscillation of said disc drive lever, and selective actuation of said disc drive lever detent means and said drive disc detent means, said drive disc is rotated intermittently in a unitary direction upon reciprocating linear motion of said actuator means; and disc drive control means for selectively operating said disc and disc drive lever detent means in response to said disc drive control signals;

said actuator means including a longitudinally fixed element and a relatively longitudinally slidable element, said slidable element movable along an actuating axis relative to said fixed element, the slidable element movable towards and away from said central axis and being attached to said disc drive lever for rotating the lever about said central axis; said fixed and slidable elements arranged to rotate the disc drive lever towards a centered position whereat the actuating axis and central axis lie in a common plane; and control means for the actuator means for causing of said actuator means periodic reciprocation to cause the disc drive lever means to rotate about the central axis up to said centered position and to cause the disc drive lever to continue rotating in the same direction after the lever has moved past said centered position; said carriage, actuating means and rotary motion converter mechanism arranged to enable rotation of the disc drive lever means past the centered position by the effect of momentum of rotary motion of the carriage following initiation of such rotary motion by said actuator means;

overcenter sensing means for generating a centered position signal indicative of the centered position of said actuator means and said disc drive lever;

said means for generating actuator control signals including means responsive to said centered position signal for controlling the actuator means as said disc drive lever approaches, traverses and passes beyond said centered position to produce continuous rotary motion of said drive disc lever towards and beyond said centered position.

11. A garment press as claimed in claim 10, including a position sensing means at said at least one work station for sensing the proximity of said at least one radial arm to said workstation, and means for generating a position signal indicative of said proximity.

12. A garment press as claimed in claim 11, wherein said actuator means comprises a fluid driven reciprocating piston and cylinder motor, said actuator control means comprising electrically controlled fluid valves for directing actuating fluid to and from the motor, and said actuator control signals are electrical signals.

13. A garment press as claimed in claim 12, wherein said disc drive lever detent means and said drive disc detent means are actuated by a fluid actuated detent motor, and including an electrically controlled fluid valve means for controlling operation of the fluid actuated detent motor.

14. A garment press as claimed in claim 13, wherein said means for generating said actuator control signals comprises a microprocessor computer, said computer including means for receiving said centered position signal and generating said actuator control signals at least in response to processing of said centered position signal; and means for communicating said centered position signal to said microprocessor computer.

15. A garment press as claimed in claim 10, including a deceleration sensor means for generating a deceleration signal; said means for generating said actuator control signals, latch release control signal and disc drive control signal comprising a microprocessor computer, said computer including means for receiving said centered position signal and deceleration signal and generating said actuator control signals and disc drive control signals in response to processing of said centered position signal and deceleration signal; and means for communicating said centered position signal and deceleration signal to said microprocessor computer.

16. A garment press as claimed in claim 15, said computer including means for generating said latch release control signal in response to processing of said centered position signal.

* * * * *